US009086074B2

(12) United States Patent
Hoffman

(10) Patent No.: US 9,086,074 B2
(45) Date of Patent: Jul. 21, 2015

(54) CEILING FAN TILT BRACKET

(71) Applicant: Alan Hoffman, Surprise, AZ (US)

(72) Inventor: Alan Hoffman, Surprise, AZ (US)

( * ) Notice: Subject to any disclaimer, the term of this patent is extended or adjusted under 35 U.S.C. 154(b) by 0 days.

(21) Appl. No.: 14/329,409

(22) Filed: Jul. 11, 2014

(65) Prior Publication Data

US 2015/0017017 A1 Jan. 15, 2015

Related U.S. Application Data

(60) Provisional application No. 61/845,149, filed on Jul. 11, 2013.

(51) Int. Cl.

| | |
|---|---|
| ***F04D 25/10*** | (2006.01) |
| ***F04D 25/08*** | (2006.01) |
| *F24F 7/00* | (2006.01) |

(52) U.S. Cl.

CPC ..... *F04D 25/105* (2013.01); *F04D 25/088* (2013.01); *F24F 7/00* (2013.01)

(58) Field of Classification Search

CPC .... F04D 19/002; F04D 25/088; F04D 25/105

USPC ..... 416/205, 244 R; 415/126

See application file for complete search history.

(56) References Cited

U.S. PATENT DOCUMENTS

| | | | | |
|---|---|---|---|---|
| 5,558,501 | A * | 9/1996 | Wang et al. | 416/244 R |
| 6,183,203 | B1 * | 2/2001 | Grintz | 416/246 |
| 6,283,709 | B1 * | 9/2001 | Hill et al. | 416/110 |
| 8,152,453 | B2 * | 4/2012 | Oleson | 415/126 |

* cited by examiner

*Primary Examiner* — Ninh H Nguyen

(57) ABSTRACT

An apparatus that is used to tilt a ceiling fan such that the air flow of the ceiling fan is redirected. The apparatus mainly consists of a first mounting piece, a second mounting piece, and an adjustment bolt. The first mounting piece and the second mounting piece surround the down tube extending downward from a ceiling fan canopy bracket. The first mounting piece and the second mounting piece are attached together with a pair of patterned bolts. When in use, a user pushes the ceiling fan in a desired direction and tightens the adjustment bolt such that it makes contact with the ceiling fan canopy bracket. In another version, the apparatus can be controlled remotely. In doing so, servos or any other comparable means can be incorporated to control the adjustment bolt. The servos can be controlled by a smart phone or similar means.

17 Claims, 12 Drawing Sheets

CEILING FAN TILT BRACKET

The current application claims a priority to the U.S. Provisional Patent application Ser. No. 61/845,149 filed on Jul. 11, 2013.

FIELD OF THE INVENTION

The present invention relates generally to the field of ceiling fans. More specifically, the present invention is a ceiling fan tilt bracket that can be attached to the down tube of a ceiling fan such that the ceiling fan can be angled in a desired direction.

BACKGROUND OF THE INVENTION

Thermoregulation is the ability of the human body to keep its internal temperature within certain boundaries even when the surrounding temperature is very different. In doing so, the human body uses methods such as shivering and sweating. Shivering is a bodily function in response to early hypothermia or coldness. Meanwhile, sweating is an essential function that helps the body to stay cool. However, drastic changes in the surrounding temperature can make a direct impact on the thermoregulation process resulting in hyperthermia or hypothermia. Developments in technology have resulted in products that can keep the human body within normal temperature ranges. For instance, heaters and warm clothing can be used to avoid body temperature from dropping below a certain temperature. Similarly, air conditioning and fans can be utilized to prevent body temperature from rising above a certain temperature.

The most widespread method of cooling the air in homes and buildings is through the use of air conditioning. Air conditioning relies on a refrigerant as a working fluid. Heat is extracted from this working fluid and then the working fluid is directed through a hot airflow. The working fluid absorbs heat from the airflow, thus cooling the air. The cooler air is then pumped back into the living areas of the home or building. Air conditioning can be found in nearly all modern homes, buildings, and even motor vehicles. Unfortunately, air conditioning requires a large amount of electricity in order to operate the associated fans, pumps, and compressors. In comparison, fans are much more cost effective.

Fans are simply contraptions which utilize an electric motor that is attached to a rotary blade. The rotary blade is shaped such that when it spins, air is pulled in through the back of the fan and propelled out the front. This flow of air is often directed over a person in order to maximize the cooling received by the person. The airflow provided by a fan can help cool a person in two ways. First, the airflow can help sweat evaporate, thus making the person feel much cooler. Second, the airflow can help remove heat from the person by way of convection. There are many different types of fans which can be commonly found in workplaces and homes across the country. Some of these types of fans include, but are not limited, to box fans, oscillating fans, and ceiling fans. Both box fans and oscillating fans can be physically repositioned by a user in order to better cool the user by directing the airflow over the user. Unfortunately, this is not the case for ceiling fans. The size of ceiling fans makes them very effective at providing the user with cooling. However, the rigid nature of the ceiling fan prevents the airflow it produces from being redirected. This is a major flaw as the airflow produced by a fan must flow over the user in order for the user to feel any cooling effect from the fan.

The objective of the present invention is to address the aforementioned issue. In particular, the present invention introduces a device that can be utilized to change the airflow of a regular ceiling fan. The effective design of the present invention allows the present invention to be used on a variety of ceiling fans. Additionally, the present invention can be either controlled manually or remotely with a smart phone or other comparable device.

DETAIL DESCRIPTIONS OF THE INVENTION

Figure 1:
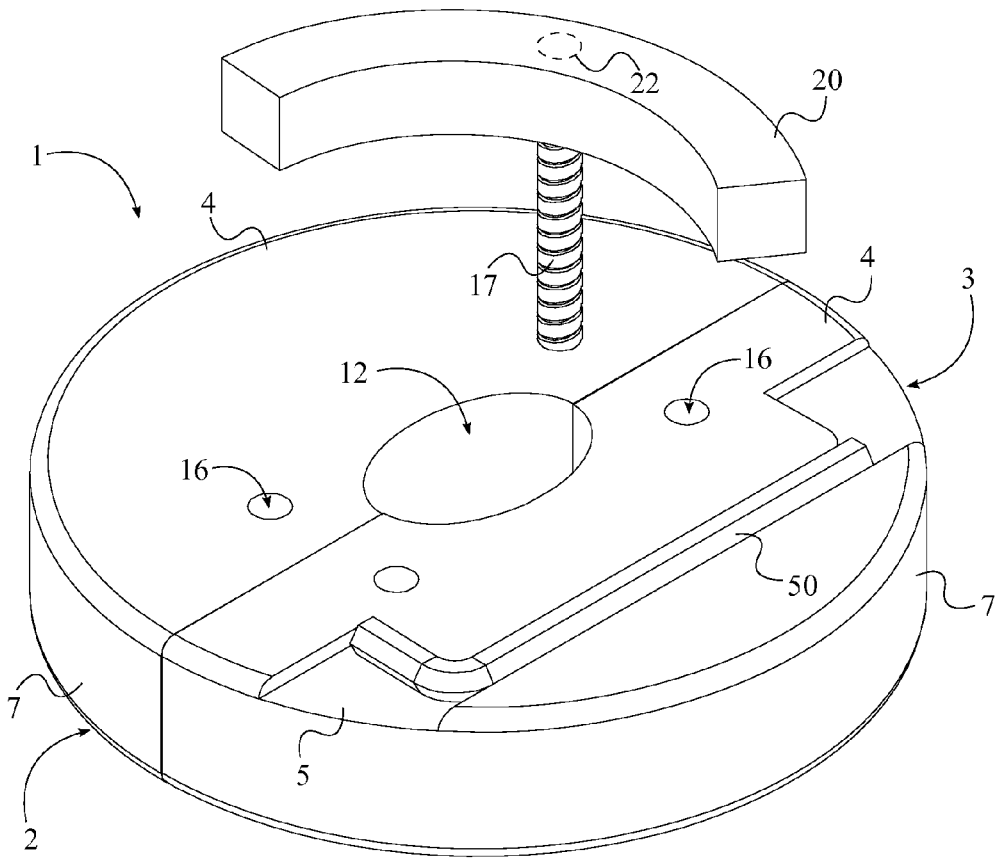
FIG. 1 is a perspective view of the present invention.

All illustrations of the drawings are for the purpose of describing selected versions of the present invention and are not intended to limit the scope of the present invention.

The present invention is an apparatus that can be used to tilt a ceiling fan such that the airflow of the ceiling fan can be redirected. The present invention comprises a mounting base 1, a down tube receiving hole 12, at least one adjustment bolt 17, and a plurality of adjustment bolt receiving holes 16. The present invention is installed around a down tube 200 extending from a ceiling fan canopy bracket 100. Typically, the down tube 200 is pivotally or hingedly connected to the ceiling fan canopy bracket 100. The mounting base 1 is utilized to install the present invention around the down tube 200. In order to tilt the ceiling fan from its leveled position, the adjustment bolt 17 is utilized. More specifically, the adjustment bolt 17 presses against the ceiling fan canopy bracket 100 such that the adjustment bolt 17 acts as a leverage point for the ceiling fan. The effective design of the present invention allows the ceiling fan to be tilted without disassembling the ceiling fan.

Figure 2:
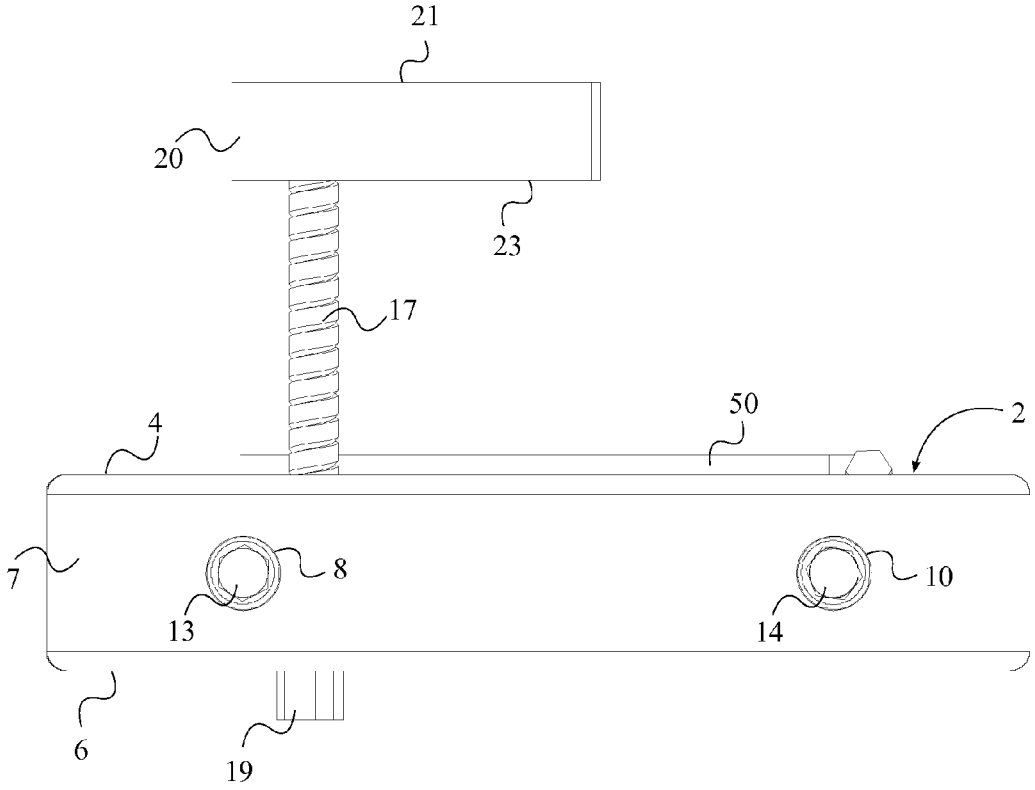
FIG. 2 is a side view of the present invention.

The mounting base 1 is installed around the down tube 200 extending from the ceiling fan canopy bracket 100. As seen in FIG. 1 and FIG. 2, the mounting base 1 comprises a first assembly piece 2, a second assembly piece 3, a top surface 4, a bottom surface 6, and a lateral surface 7. The first assembly piece 2 is detachably attached to the second assembly piece 3 such that the mounting base 1 can be conveniently installed on the down tube 200 or conveniently removed from the down tube 200. In the preferred embodiment of the present invention, both the first assembly piece 2 and the second assembly piece 3 have a semicircular planar cross section. However, in another embodiment of the present invention the first assembly piece 2 and the second assembly piece 3 can have a different planar cross section. The down tube receiving hole 12 is positioned in between the first assembly piece 2 and the second assembly piece 3. The down tube receiving hole 12 receives the down tube 200 when the mounting base 1 is installed around the down tube 200. In the preferred embodiment of the present invention, the down tube receiving hole 12 has an oval shape, which allows the present invention to be accommodate a variety of down tubes with different diameters and different cross sections. The down tube receiving hole 12 perpendicularly traverses through the mounting base 1 from the top surface 4 to the bottom surface 6 such that the down tube 200 passes through the mounting base 1.

Figure 4:
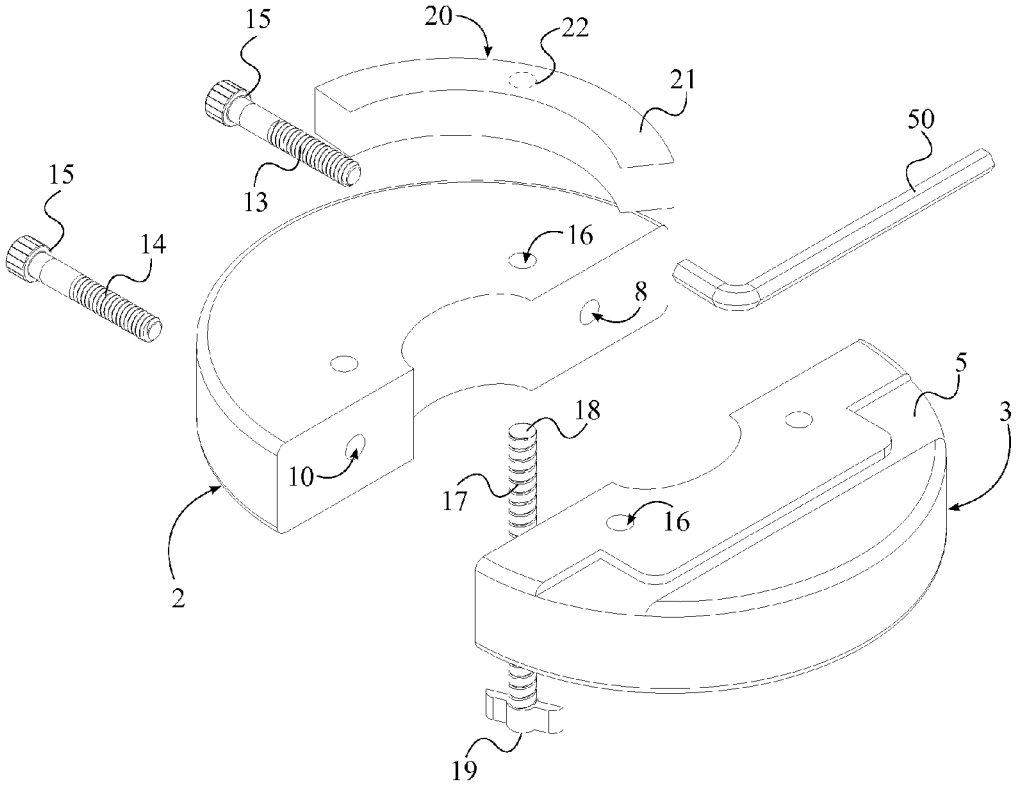
FIG. 4 is an exploded view of the present invention.
Figure 6:
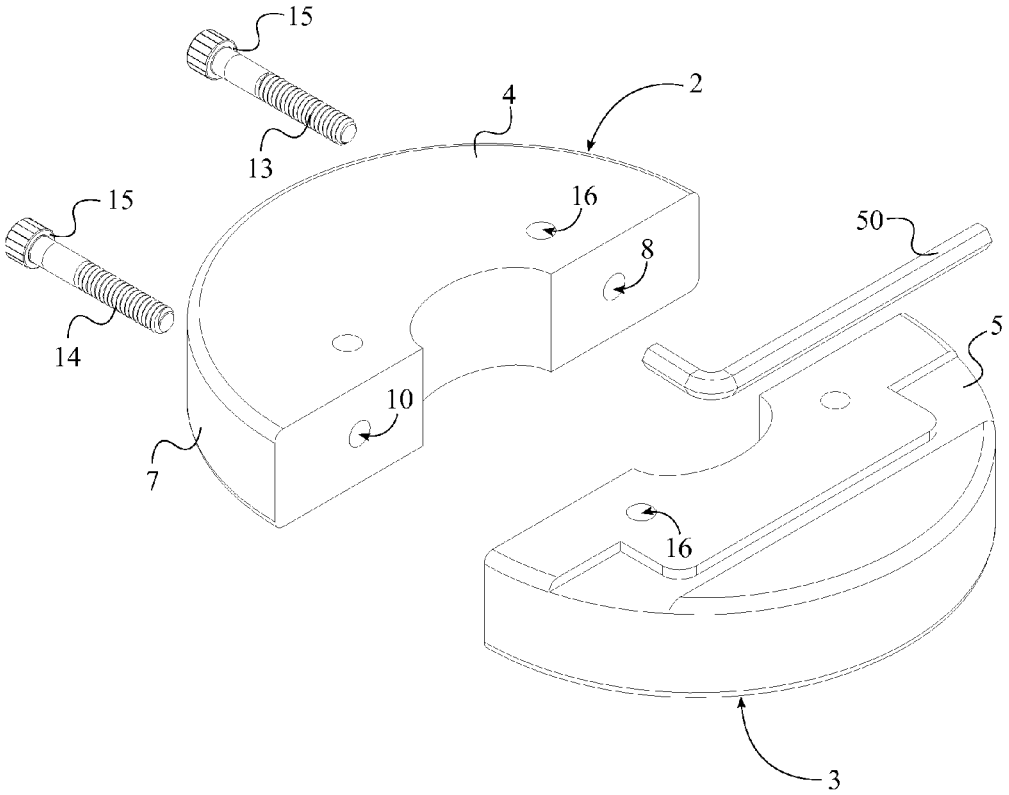
FIG. 6 is an exploded view of the mounting pieces used in the present invention.
Figure 7:
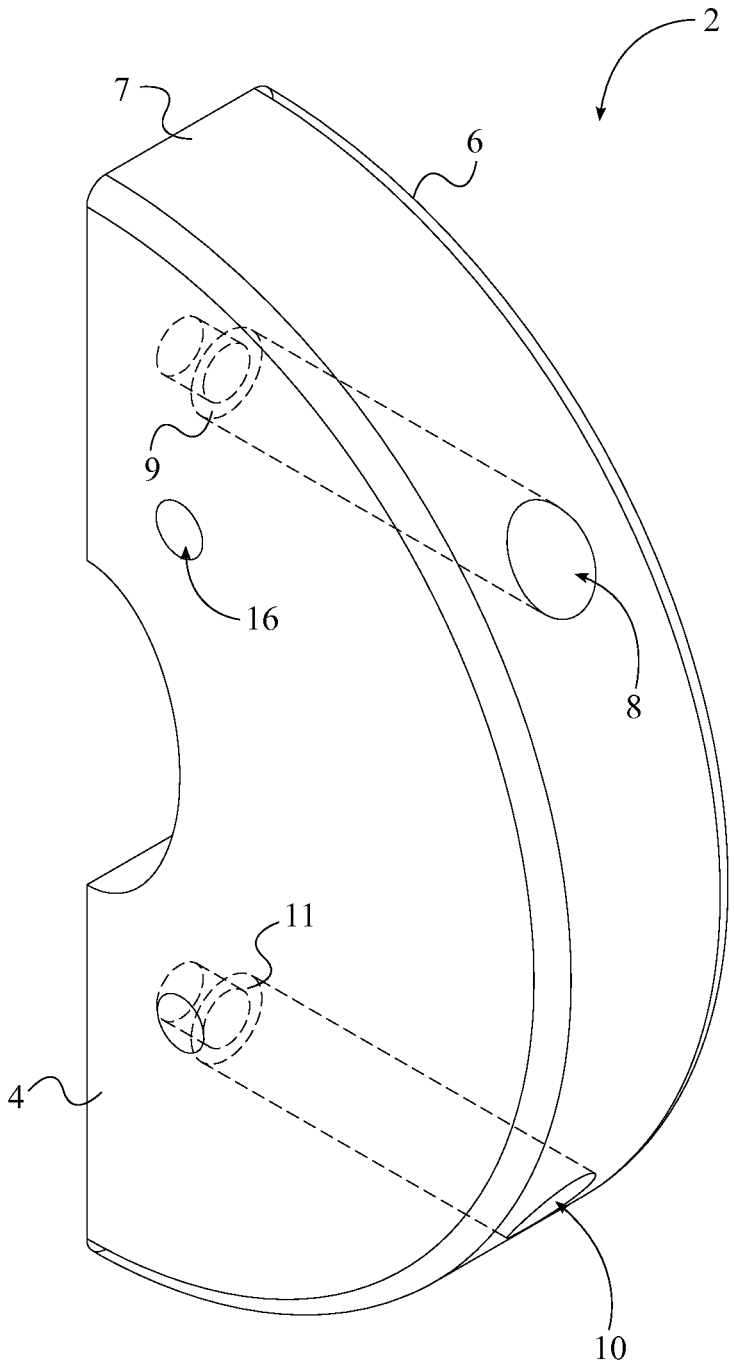
FIG. 7 is a perspective view of the first mounting piece used in the present invention.
Figure 8:
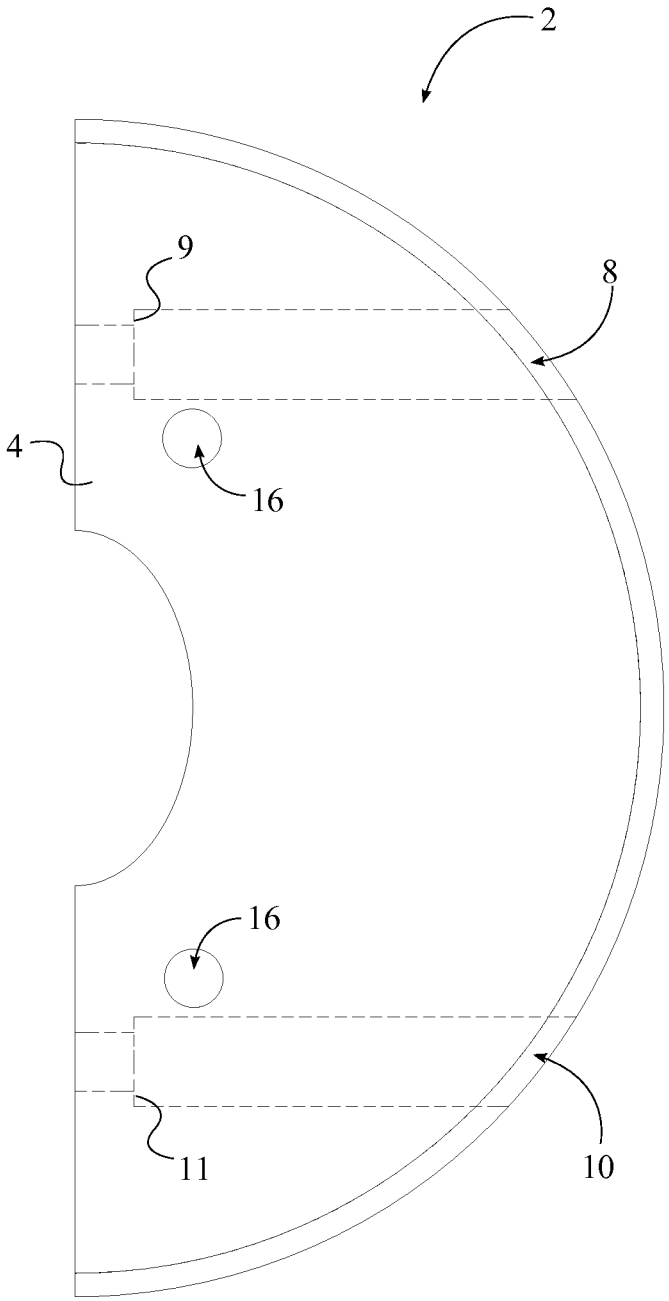
FIG. 8 is a top view of the first mounting piece used in the present invention.

As seen in FIGS. 2, 4 and 6, the first assembly piece 2 is detachably attached to the second assembly piece 3 with a first patterned bolt 13 and a second patterned bolt 14 in the preferred embodiment of the present invention. However, in another embodiment of the present invention, a different attachment mechanism can be utilized. In order to attach the first assembly piece 2 to the second assembly piece 3 with the first patterned bolt 13 and the second patterned bolt 14, the present invention further comprises a first threaded hole 8 and a second threaded hole 10. In the preferred embodiment of the present invention, the first threaded hole 8 and the second threaded hole 10 are positioned in parallel to each other. Additionally, the down tube receiving hole 12 is positioned in between the first threaded hole 8 and the second threaded hole 10. For aesthetic reasons, the first threaded hole 8 traverses through the first assembly piece 2 and into the second assembly piece 3. Similarly, the second threaded hole 10 traverses through the first assembly piece 2 and into the second assembly piece 3. However, in another embodiment of the present invention the first threaded hole 8 and the second threaded hole 10 can traverse through both the first assembly piece 2 and the second assembly piece 3. When attaching the first assembly piece 2 to the second assembly piece 3, the first patterned bolt 13 is threadably engaged with the first threaded hole 8 Likewise, the second patterned bolt 14 is threadably engaged with the second threaded hole 10. In the preferred embodiment of the present invention, the first threaded hole 8 and the second threaded hole 10 each comprises a counterbore. More specifically, the first threaded hole 8 comprises a first counterbore 9 and the second threaded hole 10 comprises a second counterbore 11 as illustrated in FIG. 7. When the first patterned bolt 13 is threadably engaged with the first threaded hole 8, a head 15 of the first patterned bolt 13 is pressed against the first counterbore 9. In a similar manner, a head 15 of the second patterned bolt 14 is pressed against the second counterbore 11 when the second patterned bolt 14 is threadably engaged with the second threaded hole 10.

Figure 9:
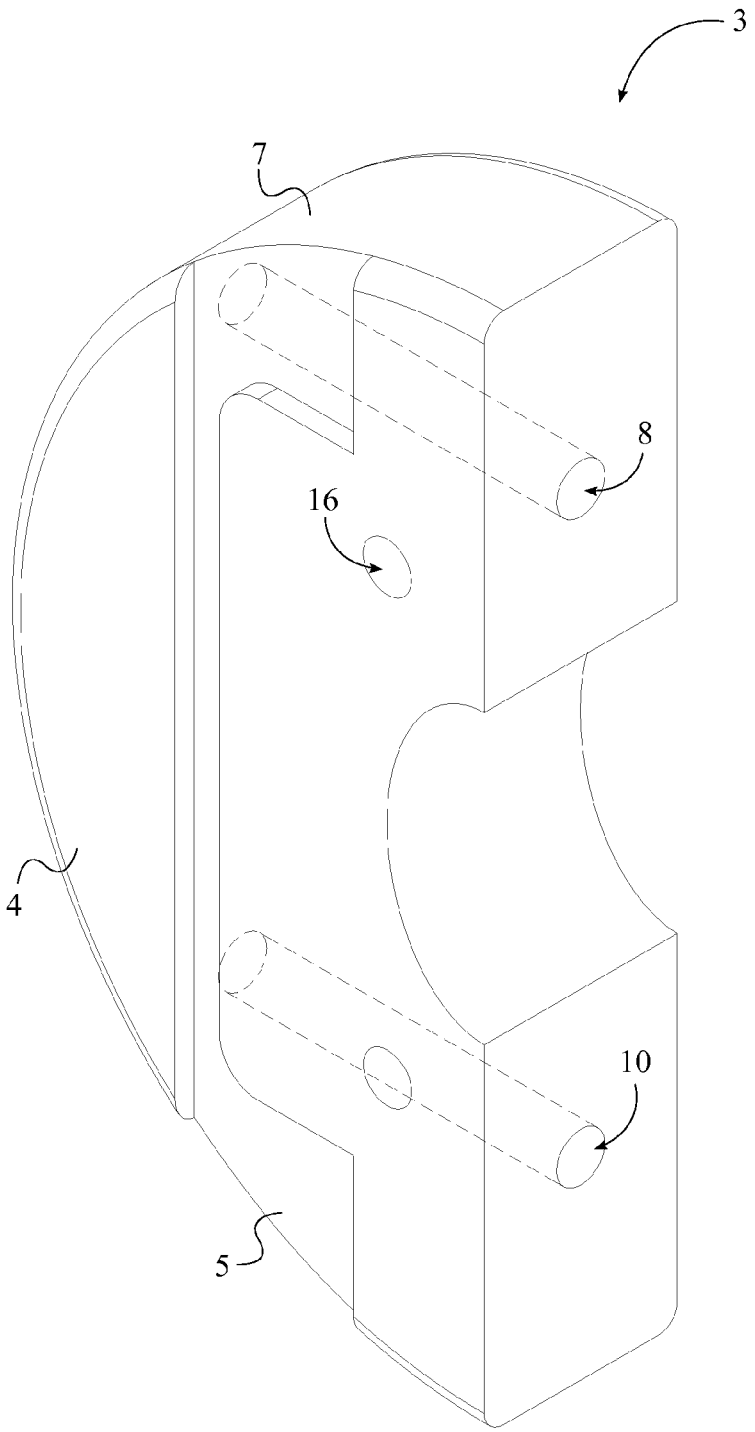
FIG. 9 is a perspective view of the second mounting piece used in the present invention.
Figure 10:
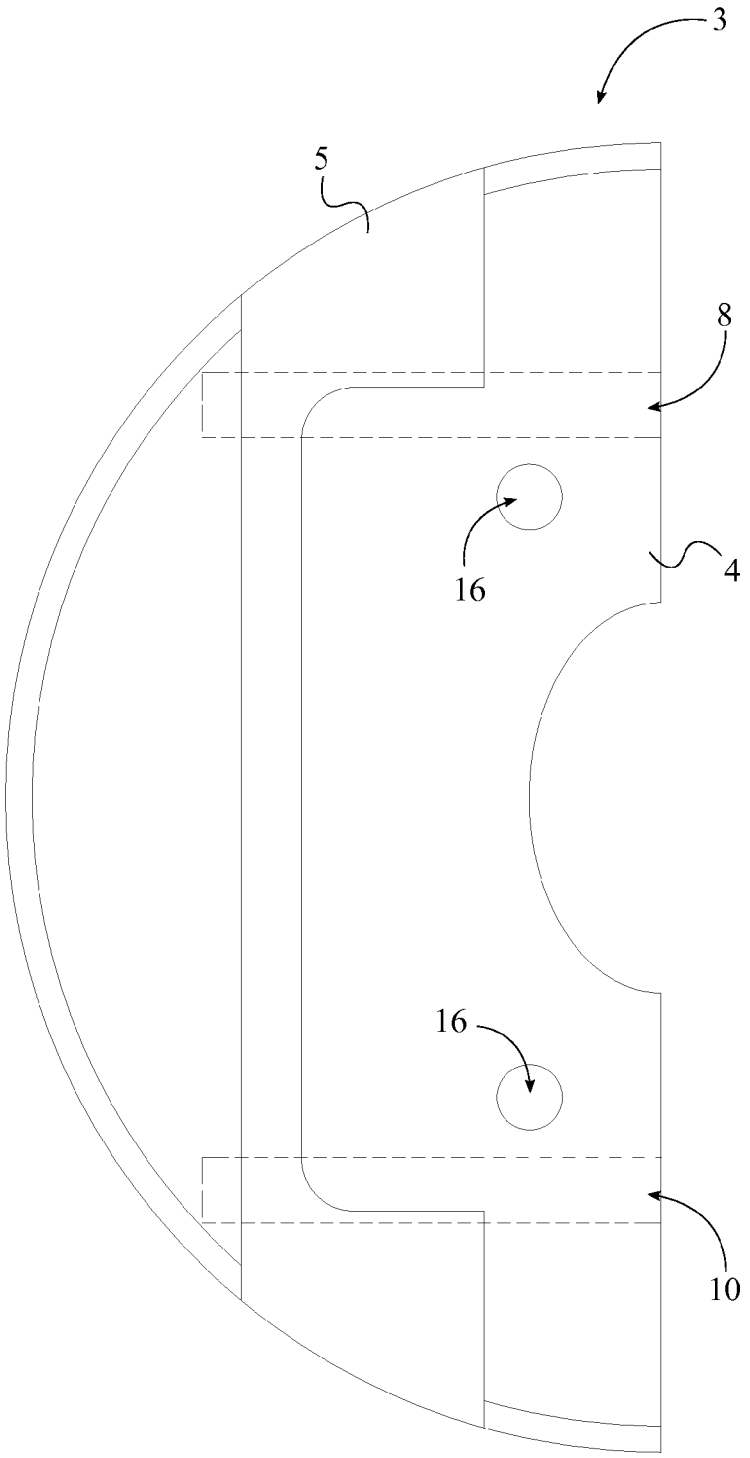
FIG. 10 is a top view of the second mounting piece used in the present invention.

In the preferred embodiment of the present invention, the first patterned bolt 13 and the second patterned bolt 14 can be respectively threaded onto the first threaded hole 8 and the second threaded hole 10 by utilizing a patterned wrench 50. The mounting base 1 further comprises a patterned wrench storing slot 5, which is integrated into the top surface 4 as seen in FIG. 9. For user convenience, the patterned wrench 50 is removably attached into the patterned wrench storing slot 5.

Figure 3:
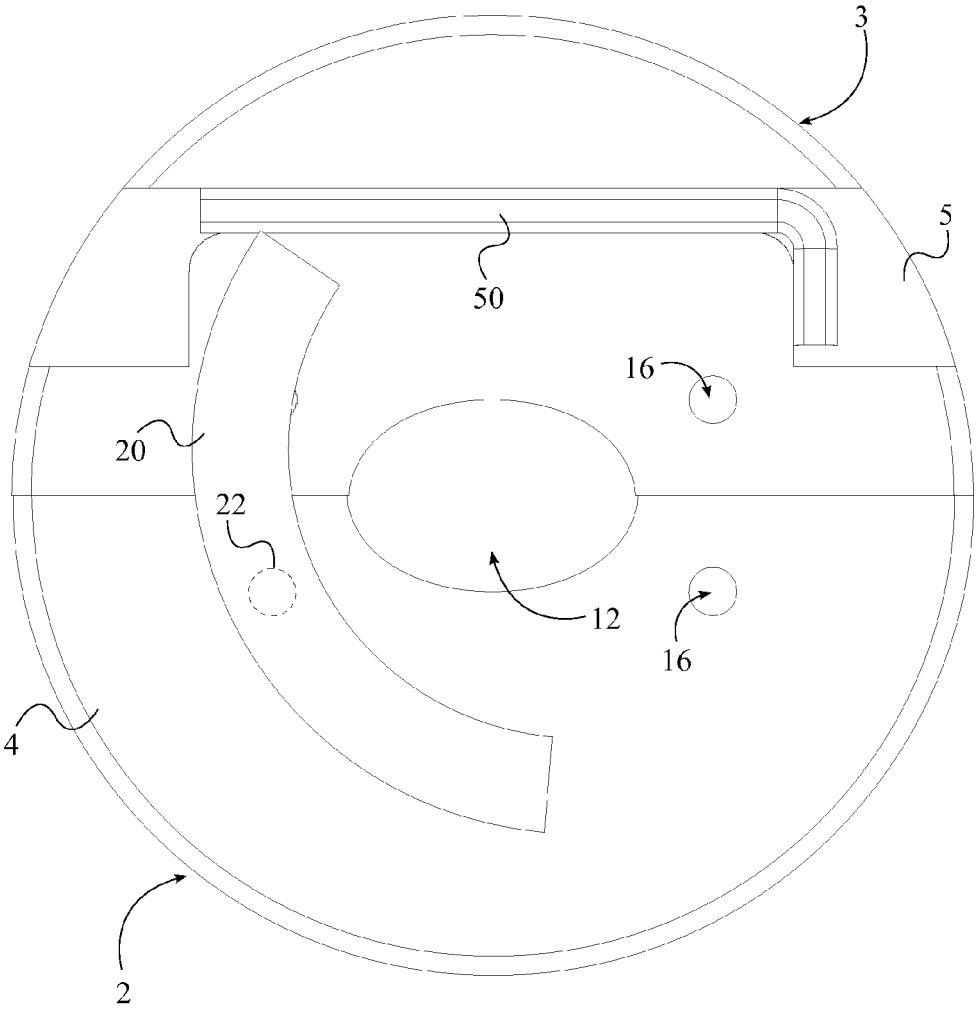
FIG. 3 is a top view of the present invention.
Figure 5:
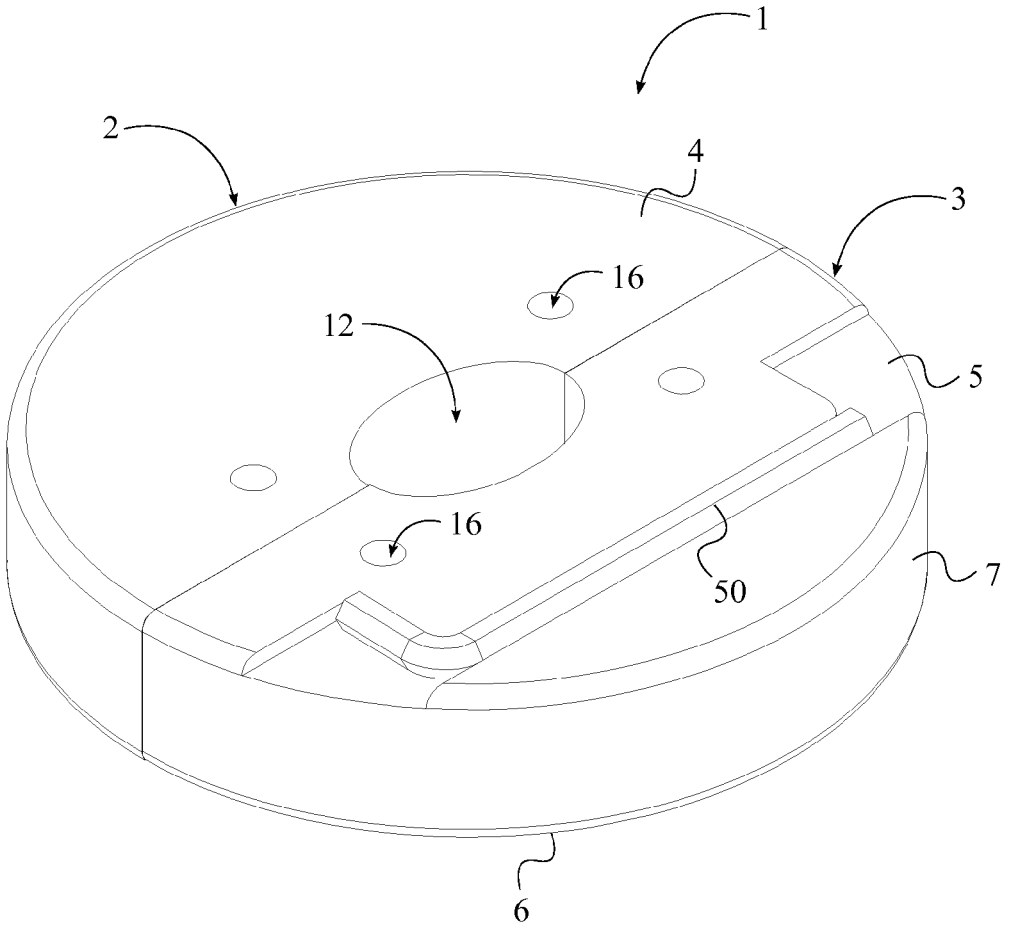
FIG. 5 is a perspective view of the mounting pieces used in the present invention.

As mentioned earlier, the adjustment bolt 17 is utilized to tilt the ceiling fan from its leveled position. In the preferred embodiment of the present invention, a thumbscrew has been utilized as the adjustment bolt 17. In another embodiment of the present invention, a similar screw or other comparable means can be utilized as the adjustment bolt 17. The plurality of adjustment bolt receiving holes 16, allows a user to create multiple leverage points. As illustrated in FIGS. 1, 3, and 5, the plurality of adjustment bolt receiving holes 16 is positioned around the down tube receiving hole 12 and traverses through the mounting base 1 parallel to the down tube receiving hole 12. The adjustment bolt 17 is positioned into one of the plurality of attachment bolt receiving holes 16. More specifically, the adjustment bolt 17 is threadably engaged with one of the plurality of adjustment bolt receiving holes 16. The adjustment bolt 17 comprises a first end 18 and a second end 19. The ceiling fan tilts when the first end 18 makes contact with the ceiling fan canopy bracket 100. More specifically, the tilting angle of the ceiling fan is controlled by the adjustment bolt 17. The present invention further comprises an adjustment bolt cap 20, which prevents the weight of the ceiling fan from being applied directly on the adjustment bolt 17. More specifically, the adjustment bolt cap 20 acts as a force distributor. In the preferred embodiment of the present invention, the adjustment bolt cap 20 has an arc-shaped planar cross section. However, in another embodiment of the present invention, any other comparable shape can also be utilized for the adjustment bolt cap 20. The adjustment bolt cap 20 comprises a top portion 21, a cap hole 22, and a bottom portion 23. The cap hole 22 perpendicularly traverses the adjustment bolt cap 20 from the bottom portion 23. The first end 18 is positioned into the cap hole 22 such that the second end 19 is simultaneously positioned adjacent to the bottom surface 6.

In the preferred embodiment of the present invention, the adjustment bolt 17 is controlled manually. However, in another embodiment the present invention can be designed to be controlled remotely. In order to do so, the present invention comprises at least one servo 51, a computing unit 52, and an external controller 53. The servo 51 is mounted onto the mounting base 1 and is utilized to control the adjustment bolt 17. In order to do so, the servo 51 is axially connected to the adjustment bolt 17. Even though the servo 51 has been utilized in the remotely controlled embodiment of the present invention, other comparable means to rotate the adjustment bolt 17 are also satisfactory. The computing unit 52 receives commands from the external controller 53 and transfers the commands to the servo 51. The external controller 53 is utilized by a user to input commands. In particular, the angle in which the ceiling fan is angled and also the direction the ceiling fan is angled to can be controlled by the external controller 53. The servo 51 is also electronically connected to the computing unit 52 which is communicably coupled to the external controller 53. As a result, a user with the external controller 53 can control the adjustment bolt 17 remotely. The external controller 53 can be, but is not limited to, a smart phone.

Figure 11:
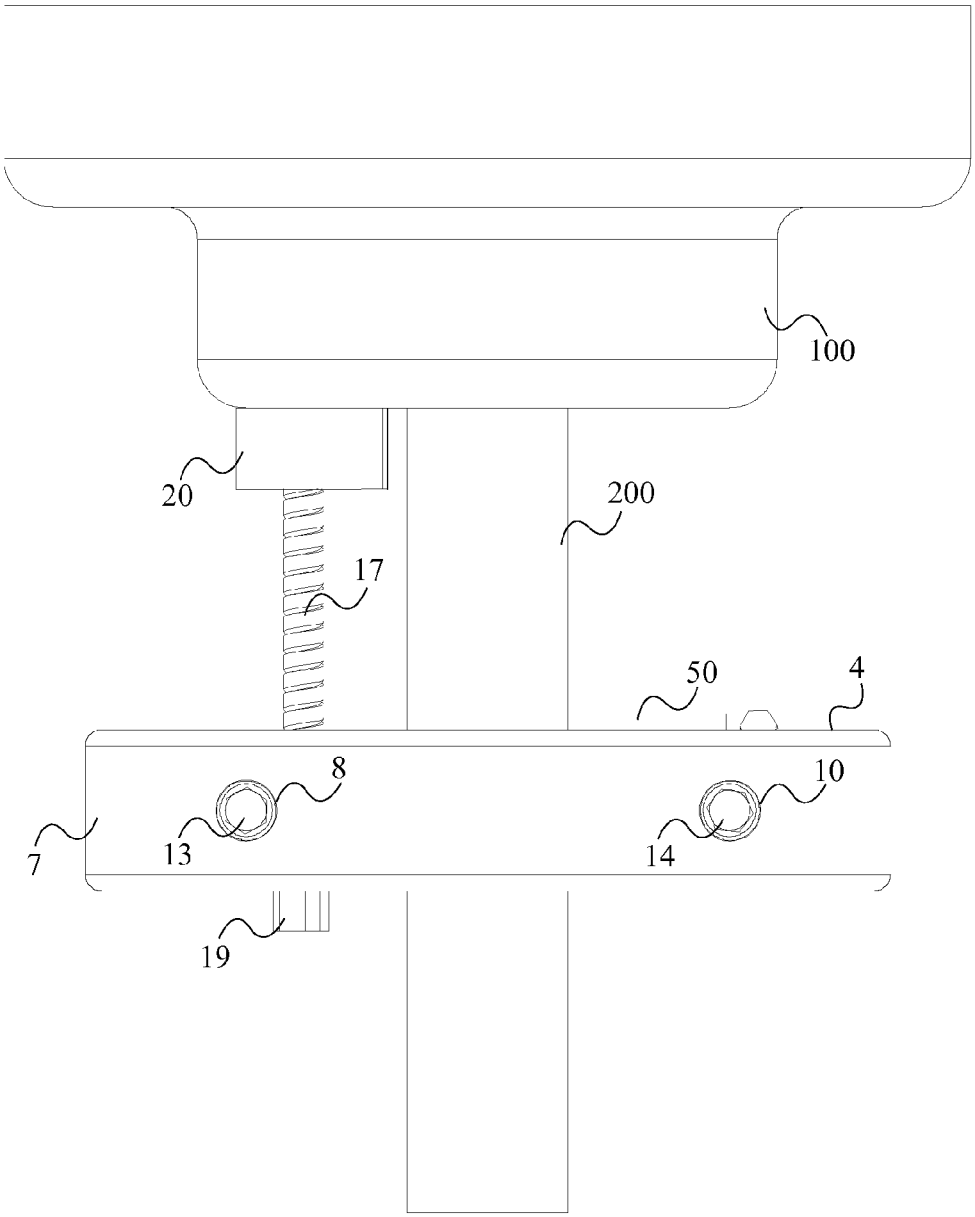
FIG. 11 is a side view of the present invention when installed on a ceiling fan canopy bracket.
Figure 12:
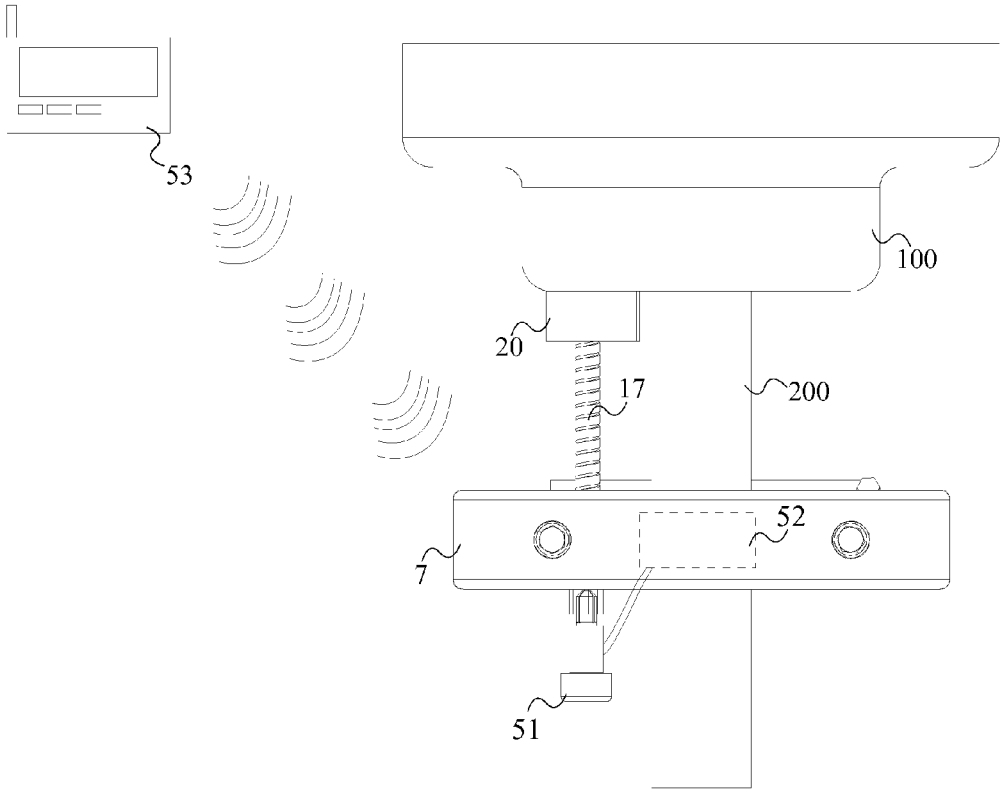
FIG. 12 is a side view of the present invention, wherein the adjustment bolt is controlled remotely.

In utilizing the present invention, the consequent process flow is followed. Initially, a user places the first assembly piece 2 and the second assembly piece 3 around the down tube 200 allowing the down tube 200 to pass through the down tube receiving hole 12. Next, the first patterned bolt 13 is fastened into the first threaded hole 8. Similarly, the second patterned bolt 14 is fastened into the second threaded hole 10. Fastening the first patterned bolt 13 and the second patterned bolt 14, stabilizes the present invention around the down tube 200. Next, the ceiling fan is tilted in the desired direction and the adjustment bolt 17 is screwed in a clockwise direction until the top portion 21 makes contact with the ceiling fan canopy bracket 100 as illustrated in FIG. 11. The tilting angle of the ceiling fan depends on the positioning of the adjustment bolt 17. In the remotely controlled embodiment of the present invention, the servo 51 executes operations according to the user commands transmitted from the external controller 53.

Although the invention has been explained in relation to its preferred embodiment, it is to be understood that many other possible modifications and variations can be made without departing from the spirit and scope of the invention as hereinafter claimed.

What is claimed is:

1. A ceiling fan tilting bracket comprises:

a mounting base;

a down tube receiving hole;

an at least one adjustment bolt;

a plurality of adjustment bolt receiving holes;

the mounting base comprises a first assembly piece, a second assembly piece, a top surface, a bottom surface, and a lateral surface;

the first assembly piece being detachably attached to the second assembly piece;

the down tube receiving hole perpendicularly traversing through the mounting base from the top surface to the bottom surface;

the down tube receiving hole being positioned in between the first assembly piece and the second assembly piece;

the plurality of adjustment bolt receiving holes traversing through the mounting base, parallel to the down tube receiving hole;

the plurality of adjustment bolt receiving holes being positioned around the down tube receiving hole; and one of the plurality of adjustment bolt receiving holes being threadably engaged by the adjustment bolt.

2. The ceiling fan tilting bracket as claimed in claim 1 comprises:

a first threaded hole;

a second threaded hole;

a first patterned bolt;

a second patterned bolt;

the first threaded hole traversing through the first assembly piece and into the second assembly piece;

the second threaded hole traversing through the first assembly piece and into the second assembly piece;

the first patterned bolt being threadably engaged with the first threaded hole; and the second patterned bolt being threadably engaged with the second threaded hole.

3. The ceiling fan tilting bracket as claimed in claim 2, wherein the first threaded hole and the second threaded hole are positioned in parallel to each other.

4. The ceiling fan tilting bracket as claimed in claim 2 comprises:

the first threaded hole comprises a first counterbore;

the second threaded hole comprises a second counterbore;

a head of the first patterned bolt being pressed against the first counterbore; and a head of the second patterned bolt being pressed against the second counterbore.

5. The ceiling fan tilting bracket as claimed in claim 2, wherein the down tube receiving hole is positioned in between the first threaded hole and the second threaded hole.

6. The ceiling fan tilting bracket as claimed in claim 1, wherein the down tube receiving hole has an oval shape.

7. The ceiling fan tilting bracket as claimed in claim 1 comprises:

a patterned wrench;

the mounting base comprises a wrench storing slot;

the wrench storing slot being integrated into the top surface; and the patterned wrench being removably attached into the wrench storing slot.

8. The ceiling fan tilting bracket as claimed in claim 1 comprises:

an adjustment bolt cap;

the adjustment bolt comprises a first end and a second end;

the adjustment bolt cap comprises a top portion, a cap hole, and a bottom portion;

the cap hole perpendicularly traversing through the adjustment bolt cap from the bottom portion;

the first end being positioned into the cap hole; and the second end being positioned adjacent to the bottom surface.

9. The ceiling fan tilting bracket as claimed in claim 8, wherein the adjustment bolt cap has an arc-shaped planar cross section.

10. The ceiling fan tilting bracket as claimed in claim 1, wherein the first assembly piece and the second assembly piece has a semicircular planar cross section.

11. The ceiling fan tilting bracket as claimed in claim 1, wherein the adjustment bolt is a thumbscrew.

12. The ceiling fan tilting bracket as claimed in claim 1 comprises:

an at least one servo;

a computing unit;

an external controller;

the servo being axially connected to the adjustment bolt;

the servo being mounted onto the mounting base;

the servo being electronically connected to the computing unit; and the computing unit being communicably coupled to the external controller.

13. The ceiling fan tilting bracket as claimed in claim 12, wherein the external controller is a smart phone.

14. A ceiling fan tilting bracket comprises:

a mounting base;

a down tube receiving hole;

an at least one adjustment bolt;

a plurality of adjustment bolt receiving holes;

a first threaded hole;

a second threaded hole;

a first patterned bolt;

a second patterned bolt;

the mounting base comprises a first assembly piece, a second assembly piece, a top surface, a bottom surface, and a lateral surface;

the first assembly piece being detachably attached to the second assembly piece;

the down tube receiving hole perpendicularly traversing through the mounting base from the top surface to the bottom surface;

the down tube receiving hole being positioned in between the first assembly piece and the second assembly piece;

the plurality of adjustment bolt receiving holes traversing through the mounting base, parallel to the down tube receiving hole;

the plurality of adjustment bolt receiving holes being positioned around the down tube receiving hole;

one of the plurality of adjustment bolt receiving holes being threadably engaged by the adjustment bolt;

the first threaded hole traversing through the first assembly piece and into the second assembly piece;

the second threaded hole traversing through the first assembly piece and into the second assembly piece;

the first patterned bolt being threadably engaged with the first threaded hole;

the second patterned bolt being threadably engaged with the second threaded hole;

the first threaded hole and the second threaded hole being positioned in parallel to each other;

the down tube receiving hole being oval in shape;

the down tube receiving hole being positioned in between the first threaded hole and the second threaded hole;

the planar cross section of the first assembly piece and the second assembly piece being semicircular; and the adjustment bolt being a thumbscrew.

15. The ceiling fan tilting bracket as claimed in claim 14 comprises:

a patterned wrench;

the first threaded hole comprises a first counterbore;

the second threaded hole comprises a second counterbore;

a head of the first patterned bolt being pressed against the first counterbore;

a head of the second patterned bolt being pressed against the second counterbore;

the mounting base comprises a wrench storing slot;

the wrench storing slot being integrated into the top surface; and the patterned wrench being removably attached into the wrench storing slot.

16. The ceiling fan tilting bracket as claimed in claim 14 comprises:

an adjustment bolt cap;

the adjustment bolt comprises a first end and a second end;

the adjustment bolt cap comprises a top portion, a cap hole, and a bottom portion;

the cap hole perpendicularly traversing through the adjustment bolt cap from the bottom portion;

the first end being positioned into the cap hole;

the second end being positioned adjacent to the bottom surface; and the planar cross section of the adjustment bolt cap being an arc-shape.

17. The ceiling fan tilting bracket as claimed in claim 14 comprises:

an at least one servo;

a computing unit;

an external controller;

the servo being axially connected to the adjustment bolt;

the servo being mounted onto the mounting base;

the servo being electronically connected to the computing unit;

the computing unit being communicably coupled to the external controller; and the external controller being a smart phone.

* * * * *